US005979129A

United States Patent [19]

Azar

[11] Patent Number: 5,979,129

[45] **Date of Patent: *Nov. 9, 1999**

[54] EXTRUDED CARPENTRY FRAMING

[76] Inventor: Tony J. Azar, 1038 Lesperance Road, Tecumseh, Ontario, Canada, N8N 1W8

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,531

[22] Filed: Aug. 19, 1997

[30] Foreign Application Priority Data

Dec. 9, 1996 [CA] Canada ..... 2192420

[51] Int. Cl.[6] ..... E06B 1/26; E04F 19/02

[52] U.S. Cl. ..... 52/211; 52/213; 52/288.1; 52/716.8; 52/717.01; 52/717.05

[58] Field of Search ..... 52/211, 213, 288.1, 52/716.8, 717.01, 717.05, 717.06, 287.1, 460; 49/DIG. 2, 504

[56] References Cited

U.S. PATENT DOCUMENTS

| | | | |
|---|---|---|---|
| 1,278,827 | 9/1918 | Baxter | 52/213 |
| 1,910,554 | 5/1933 | Loehr et al. | 52/717.06 |
| 1,994,976 | 3/1935 | Wread | 52/213 |
| 2,718,291 | 9/1955 | Goldberg | 52/364 X |
| 2,755,895 | 7/1956 | Walterman et al. | 52/211 |
| 2,843,232 | 7/1958 | Goldberg | 52/211 |
| 3,855,746 | 12/1974 | Leggiere | 52/213 |
| 3,886,688 | 6/1975 | Ragland | 52/213 X |
| 4,005,558 | 2/1977 | Barrison | 52/213 |
| 4,545,162 | 10/1985 | Attaway | 52/288.1 X |
| 4,622,791 | 11/1986 | Cook et al. | 52/288.1 X |
| 4,827,683 | 5/1989 | Poole | 52/717.05 X |
| 5,146,723 | 9/1992 | Greenwood et al. | 52/288.1 X |
| 5,392,574 | 2/1995 | Sayers | 52/213 X |
| 5,517,794 | 5/1996 | Wagner | 52/288.1 X |
| 5,531,050 | 7/1996 | Stibolt et al. | 52/716.8 X |
| 5,542,222 | 8/1996 | Wilson et al. | 52/288.1 X |

*Primary Examiner*—Laura A. Callo
*Attorney, Agent, or Firm*—Anthony J. Casella; Gerald E. Hespos

[57] ABSTRACT

This invention relates to extruded carpentry framing, and particularly to extruded framing consisting of one piece construction having a complete finished look and connecting to traditional interior wall construction. The invention will allow quick and simple assembly of framing necessary for swinging, bifold and sliding doors.

4 Claims, 1 Drawing Sheet

EXTRUDED CARPENTRY FRAMING

FIELD OF INVENTION

This invention relates to extruded carpentry framing, and particularly to extruded framing consisting of one piece construction having a complete finished look and connecting to traditional interior wall construction. The invention is directed towards providing extruded framing for doors.

BACKGROUND OF THE INVENTION

Presently, the construction industry has various commercially available extruded frames for doors and window openings. Generally speaking, extruded frames provide for a quick and efficient means to assemble a supporting frame for doors and windows.

However, many problems exist in applying these commercially available extruded frames to simple carpentry applications such as closet door openings. The majority of conventional extruded frames are quite complex in construction and assembly, being more suited for insulated glazing applications.

More specifically, one such problem is that available extruded frames are primarily directed to receiving and supporting heavy construction doors and windows. In addition, presently available extruded frames require additional work to complete the finished look. For instance, often capping of the extruded frame is necessary to providing trimming to give the finished look of the extruded frame. Moreover, current extruded framing systems are made up of extruded multi-parts. These multi-parts are then snapped together to form the final frame assembly. Inherently, the end result of these multi-part systems is that frame assembly costs escalate because of increased labour time in putting together the frame.

Accordingly, there is a need for a simple one piece framing system which is easily constructed, easily assembled, completely finished and overcomes the drawbacks of prior art extruded frame systems.

OBJECTS AND SUMMARY OF THE INVENTION

It is a first object of the invention to a provide an extruded framing system which has a one piece construction.

Another object of the invention is to reduce the cost in providing an extruded frame.

Another object of the invention is to provide a simple means to quickly assemble an extruded frame.

The invention will be further described with reference to the following drawings.

DETAILED DESCRIPTION OF THE INVENTION

Figure 1:
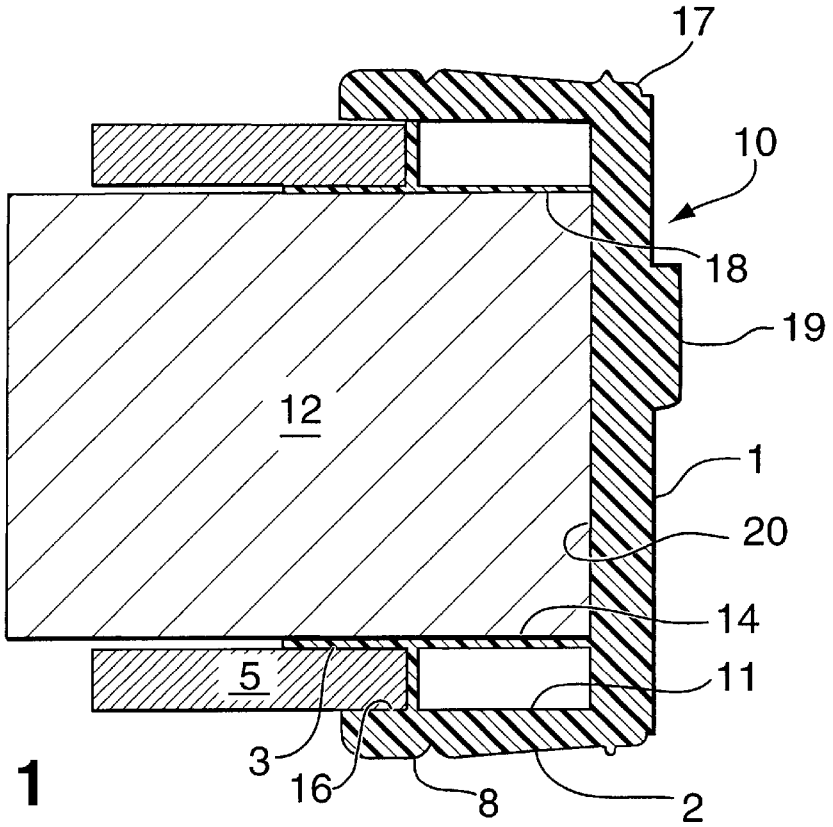
FIG. 1 is a cross-sectional view showing an extruded carpentry framing system according to the invention.

Turning to FIG. 1 there is shown an extruded frame 10 according to a preferred embodiment of the invention made of a single extruded piece. It is to understood that the elements described below extend continuously in a single extruded piece. In the first embodiment the extruded carpentry frame 10 includes a main central panel 1 to receive both swinging and sliding door panels (not shown). The central panel 1 has an outwardly extending extruded jamb 19 so as to act as a door stop and/or provide a finished look by covering any gap (not shown) between the door and panel 1.

The following description of the preferred embodiment describes the extruded integral channel forming components that make up the invention. Cap 2 extends substantially perpendicular from one end of central panel 1. For a matter of convenience, the terms "outwardly", "outward", etc. refer to surfaces facing away from the wall construction. The terms "inwardly", "inward", etc. refer to surfaces facing towards the wall construction. On outwardly exposed side 8 of cap 2 there is provided an extruded design finish. The design finish on cap 2 provides aesthetic trimming to frame 10 and may be of various designs. On inwardly side 11 of cap 2 there is provided a flat surface. Drywall stop 4 extends perpendicularly from side 11 to intersect with arm 14. Arm 14 extends from the central panel 1 parallel to the side 11 and continues past drywall stop 4. The extension of arm 14 past the drywall stop is referenced as flange 3. The extension of cap 2 past drywall stop 4 is referenced as flange 16. The distance between flange 16 and flange 3 is approximately the thickness of commercially available drywall panels. The outward facing side of flange 3 forms in conjunction with drywall stop 4 and the inward facing side of flange 16 an integral channel to receive the drywall 5 component of the wall construction in which the system is installed.

In a similar nature, the integral channel forming components of the extruded frame described above are mirrored on the other end of central panel 1 to provide for a parallel structure 17 to receive a separate drywall component that is parallel to drywall component 5. The inner side of arms 14 and 18 in conjunction with inner side 20 of central panel 1 forms an integral continuous channel to receive the stud 12 component of the wall construction. The stud channel is continuous and abuts stud 12 throughout its length.

Figure 2:
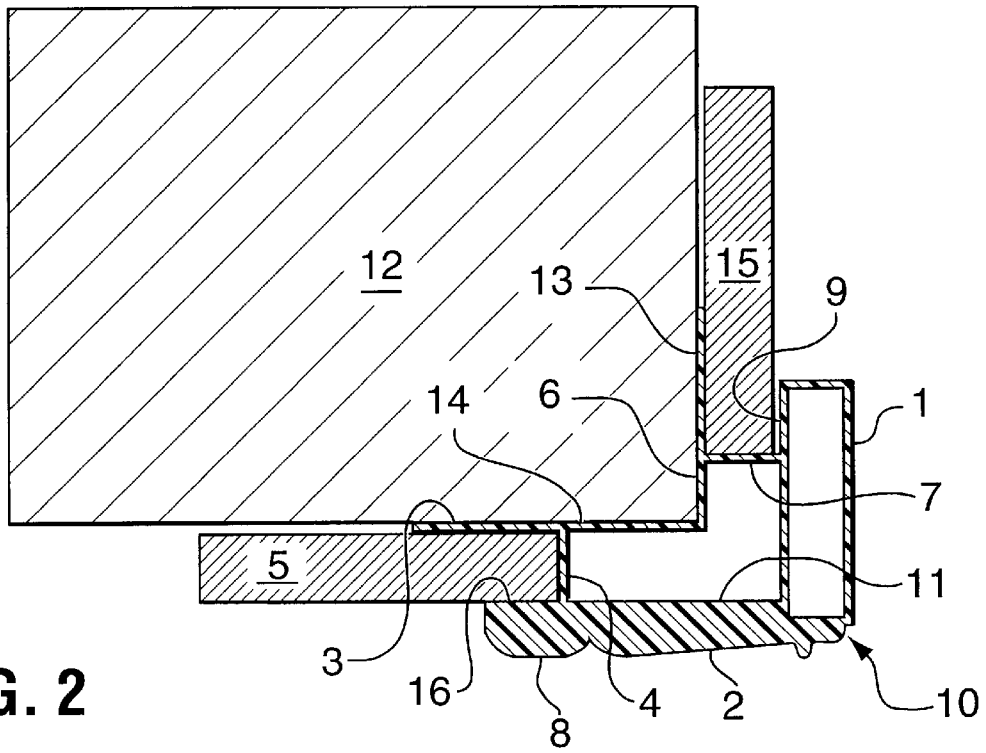
FIG. 2 is a cross-sectional view showing another preferred embodiment of an extruded carpentry framing system according to the invention directed towards corner constructions.

Turning to FIG. 2, another preferred embodiment of the invention is shown for situations where framing is applied to corner wall construction. Like numerals are used where like parts are illustrated. Similar to the first embodiment, at one end of main panel 1 extends cap 2 with a finished design surface 8. From the inward side of cap 2 extends drywall stop 4. The portion of cap 2 that extends beyond drywall stop 4 is referred to as flange 16. The distance between flange 16 and flange 3 is approximately the thickness of commercially available drywall panels. Flange 3, drywall stop 4 and flange 16 together form an integral channel to receive the drywall component 5 of the wall construction. Arm 14 is perpendicularly connected to arm 6. Arm 6 extends past drywall stop 7 to form flange 13. Drywall stop 7 connects arm 6 and main panel 1. Inner wall 9 of central panel 1 in conjunction with drywall stop 7 and outward facing wall of flange 13 forms an integral channel to receive the drywall 15 component of the wall construction. Although main panel 1 is illustrated with a hollow cross-section, it is envisioned that this element like other similar elements of this invention may be extruded to be either solid in cross-section or hollow. Finally, arms 14 and 6 and their respective flanges form another integral channel. This integral channel receives stud 12. The stud channel is continuous and abuts stud 12 throughout its length.

The material of the extruded framing system is preferably a thermoplastic. In certain situations it is expected that additional coatings of paint or laminate may be added to the surface to provide a different aesthetic look. The laminate may be added during the extrusion process.

INSTALLATION

The installation of the frame is simple and quick. The installation will consist of the installer measuring the dimensions of the opening needed to be framed. The extruded frame will be pre-cut into various lengths. As a result, the installer will need to cut the necessary length of frame to produce a customized frame length. Odd length pieces may be recycled and re-formed as full length pieces. In this way there is little or no wastage of extruded carpentry framing. To ensure that the frame properly abuts adjacent frames at right angle turns in the door opening, the frame is cut diagonally. In this description of the installation procedure it is assumed the drywall is not yet installed in the wall construction where the frame is to be installed. The customized frame lengths are then attached to the stud construction by aligning the stud receiving channel with the stud. While pressing the custom frame length against the stud component, screws may be drilled through pre-formed screw-holes (not illustrated) in flanges 3 and 13 at various intervals throughout its length to ensure a secure connection with the wall construction. The drywall component then slips into drywall receiving channels of frame 10. The edge of the drywall components preferably abut drywall stops 4, 7. Hardware accessories such as sliding door guides or door hinges (not shown) may be added to the frame by screwing the necessary accessories onto central panel 1.

The above-described embodiments of the present invention are meant to be illustrative of a preferred embodiment of the present invention and are not intended to limit the scope of the present invention. Various modifications, which would be readily apparent to one skilled in the art, are intended to be within the scope of the present invention. The only limitations to the scope of the present invention are set out in the following appended claims.

What is claimed is:

1. A combination comprising:

a stud component;

a drywall component; and an extruded carpentry framing system, said system having one continuous uninterrupted extruded frame body, said body having at least one integral channel receiving the drywall component, said body having at least one continuous channel, wherein the continuous channel is U-shaped and abuts the stud component such that every surface of said U-shaped continuous channel is in contact with the stud component, said continuous channel lying parallel to said integral channel such that the stud component and the drywall component are received in a parallel plane arrangement, said continuous channel and said integral channel being separated by a portion of said body having a uniform thickness throughout as measured between said continuous channel and said integral channel.

2. The combination of claim 1, wherein said integral channel and said continuous channel provide for the meshing of the drywall component with said integral channel and the meshing of the stud component with said continuous channel.

3. The combination of claim 2, wherein said integral channel and said continuous channel are adapted to lock securely in place the drywall component and the stud component.

4. The combination of claim 3, wherein said body includes means to attach the framing system to the stud component.

* * * * *